US009551103B2

(12) United States Patent
Goshgarian et al.

(10) Patent No.: US 9,551,103 B2
(45) Date of Patent: Jan. 24, 2017

(54) METHOD TO DETECT THE TYPE OF A LOAD IN A LAUNDRY TREATING APPLIANCE

(71) Applicant: Whirlpool Corporation, Benton Harbor, MI (US)

(72) Inventors: David P. Goshgarian, Benton Harbor, MI (US); Andrew J. Leitert, Eau Claire, MI (US); Karl David McAllister, Stevensville, MI (US); Amy L. Rapson, Holland, MI (US); Yingqin Yuan, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 604 days.

(21) Appl. No.: 13/965,512

(22) Filed: Aug. 13, 2013

(65) Prior Publication Data

US 2015/0047128 A1 Feb. 19, 2015

(51) Int. Cl.
*D06F 39/00* (2006.01)
*D06F 33/02* (2006.01)

(52) U.S. Cl.
CPC ..... *D06F 39/003* (2013.01); *D06F 33/02* (2013.01); *D06F 2202/10* (2013.01); *D06F 2202/12* (2013.01); *D06F 2204/088* (2013.01)

(58) Field of Classification Search
CPC ..... D06F 2058/2861; D06F 39/003; D06F 2202/06; D06F 2202/10; D06F 2202/12
See application file for complete search history.

(56) References Cited

U.S. PATENT DOCUMENTS

| | | | | |
|---|---|---|---|---|
| 5,144,819 | A | 9/1992 | Hiyama et al. | |
| 5,259,217 | A | 11/1993 | Civanelli et al. | |
| 5,768,729 | A | 6/1998 | Cracraft | |
| 6,634,191 | B1 | 10/2003 | Guler et al. | |
| 6,760,942 | B2 * | 7/2004 | Lee | D06F 33/02 68/12.04 |
| 2009/0241605 | A1 | 10/2009 | Moore | |
| 2010/0024490 | A1 | 2/2010 | Nieh et al. | |
| 2011/0030150 | A1 * | 2/2011 | Ashrafzadeh | D06F 39/003 8/159 |

FOREIGN PATENT DOCUMENTS

| | | | |
|---|---|---|---|
| EP | 0649932 | B1 | 5/1999 |
| EP | 2094893 | B1 | 9/2011 |
| KR | 0132499 | B1 | 12/1997 |
| WO | 2011080231 | A2 | 7/2011 |

* cited by examiner

*Primary Examiner* — David Cormier

(57) ABSTRACT

A method of determining load type in a laundry treating appliance having a treating chamber for receiving laundry, a rotatable laundry mover, and a motor operably coupled to the rotatable laundry mover includes steps to apply a perturbation force to the laundry in the treating chamber by rotating the laundry mover with the motor; determine the response of the motor torque to the perturbation force during the rotating of the laundry mover; and determine a load type based on the determined response.

20 Claims, 5 Drawing Sheets

METHOD TO DETECT THE TYPE OF A LOAD IN A LAUNDRY TREATING APPLIANCE

BACKGROUND OF THE INVENTION

Laundry treating appliances, such as a washing machine, may have a rotatable drum in which laundry may be placed for treatment. For some laundry treating appliances, the laundry may be provided with liquid to treat the laundry in accordance with a cycle of operation. The laundry may absorb a portion of the liquid where the amount of liquid absorbed by the laundry may differ by the composition of the laundry. For example, the laundry having cotton tends to absorb a high amount of liquid, while the laundry having polyester tends to absorb a small amount of liquid. Additionally, the user of the appliance may set the wash temperature of the cycle of operation based upon the constituent fabric of the clothes.

SUMMARY OF THE INVENTION

The invention relates to a method of determining load type in a laundry treating appliance. The laundry treating appliance can have a treating chamber for receiving laundry, a rotatable laundry mover, and a motor operably coupled to the rotatable laundry mover. The method includes steps to apply a perturbation force to the laundry in the treating chamber by rotating the laundry mover with the motor; determine the response of the motor torque to the perturbation force during the rotating of the laundry mover; and determine a load type based on the determined response.

DESCRIPTION OF EMBODIMENTS OF THE INVENTION

Figure 1:
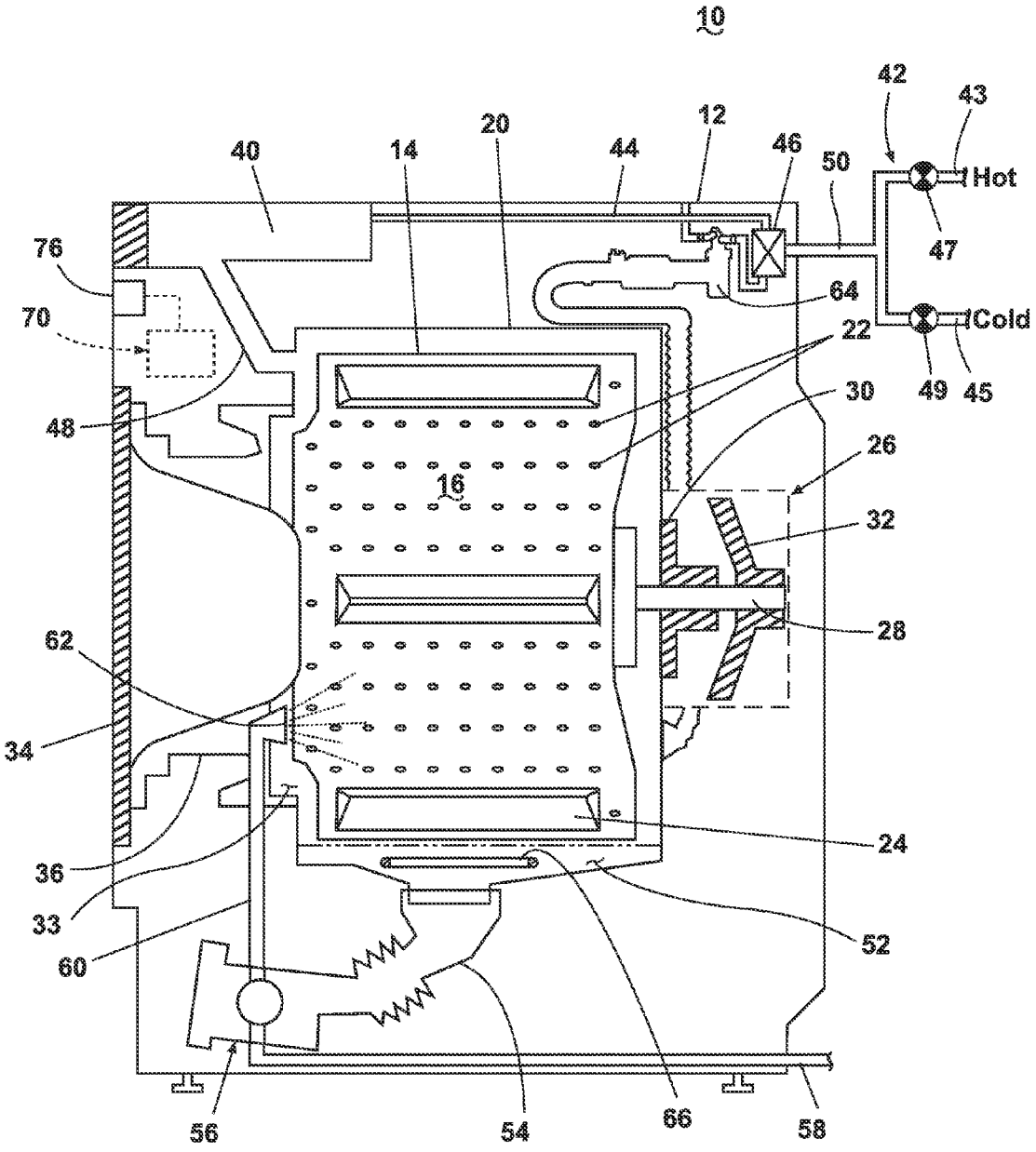
FIG. 1 is a schematic cross-sectional view of a laundry treating appliance according to one embodiment of the invention.

FIG. 1 illustrates a laundry treating appliance in the form of a horizontal axis washing machine 10 according to one embodiment of the invention. The laundry treating appliance may be any machine that treats articles such as clothing or fabrics. Non-limiting examples of the laundry treating appliance may include a top loading/vertical axis washing machine; a front loading/horizontal axis washing machine; a combination washing machine and dryer; and a refreshing/revitalizing machine. The washing machine 10 described herein shares many features of a traditional automatic washing machine, which will not be described in detail except as necessary for a complete understanding of the invention.

Washing machines are typically categorized as either a vertical axis washing machine or a horizontal axis washing machine. As used herein, the "vertical axis" washing machine refers to a washing machine having a rotatable drum, perforate or imperforate, that holds fabric items and a clothes mover, such as an agitator, impeller, nutator, and the like within the drum. The clothes mover moves within the drum to impart mechanical energy directly to the clothes or indirectly through liquid in the drum. The liquid may include one of wash liquid and rinse liquid. The wash liquid may have at least one of water and a wash aid. Similarly, the rinse liquid may have at least one of water and a wash aid. The clothes mover may typically be moved in a reciprocating rotational movement. In some vertical axis washing machines, the drum rotates about a vertical axis generally perpendicular to a surface that supports the washing machine. However, the rotational axis need not be vertical. The drum may rotate about an axis inclined relative to the vertical axis. As used herein, the "horizontal axis" washing machine refers to a washing machine having a rotatable drum, perforate or imperforate, that holds fabric items and washes the fabric items by the fabric items rubbing against one another as the drum rotates. In some horizontal axis washing machines, the drum rotates about a horizontal axis generally parallel to a surface that supports the washing machine. However, the rotational axis need not be horizontal. The drum may rotate about an axis inclined relative to the horizontal axis. In horizontal axis washing machines, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric articles. The illustrated exemplary washing machine of FIG. 1 is a horizontal axis washing machine.

As illustrated in FIG. 1, the horizontal axis washing machine 10 may have a cabinet 12 that includes a rotatable drum 14 defining a treating chamber 16. A tub 20 may be positioned within the cabinet 12 and may define a liquid chamber 33 within which the rotatable drum 14 may be positioned for receiving laundry to be treated during a cycle of operation. The rotatable drum 14 may include a plurality of perforations 22, such that liquid may flow between the tub 20 and the drum 14 through the perforations 22. The drum 14 may further include a plurality of impeller vanes 24 disposed on an inner surface of the drum 14 with predetermined gaps between the impeller vanes 24 to lift the laundry load received in the treating chamber 16 while the drum 14 rotates.

While the illustrated washing machine 10 includes both the tub 20 and the drum 14, with the drum 14 defining the laundry treating chamber 16, it is within the scope of the invention for the washing machine 10 to include only one receptacle, with the receptacle defining the laundry treating chamber 16 for receiving the laundry load to be treated.

A motor 26 may be directly coupled with the drive shaft 28 to rotate the drum 14 at a predetermined speed and direction. The motor 26 may be a brushless permanent magnet (BPM) motor having a stator 30 and a rotor 32. Alternately, the motor 26 may be coupled to the drum 14 through a belt and a drive shaft to rotate the drum 14, as is known in the art. Other motors, such as an induction motor or a permanent split capacitor (PSC) motor, may also be used. The motor 26 may rotate the drum 14 at various speeds in either rotational direction.

Both the tub 20 and the drum 14 may be selectively closed by a door 34. A bellows 36 couples an open face of the tub 20 with the cabinet 12, and the door 34 seals against the bellows 36 when the door 34 closes the tub 20.

A detergent dispenser 40 may be provided to the washing machine 10 to dispense a treating chemistry during a cycle of operation. As illustrated, the detergent dispenser 40 may be located in the interior of the cabinet 12 such that the treating chemistry may be dispensed to the interior of the tub 20, although other locations are also possible. The detergent dispenser 40 may include a reservoir of treating chemistry that is releasably coupled to the detergent dispenser 40, which dispenses the treating chemistry from the reservoir to the treating chamber 16. The treating chemistry may be any type of chemistry for treating laundry, and non-limiting examples include, but are not limited to detergents, surfactants, enzymes, fabric softeners, sanitizers, de-wrinklers, and chemicals for imparting desired properties to the laundry, including stain resistance, fragrance (e.g., perfumes), insect repellency, and UV protection.

The washing machine 10 may further include a liquid supply and recirculation system. Liquid, such as water, may be supplied to the washing machine 10 from a water supply 42, such as a household water supply. The water supply may include a water supply configured to supply hot or cold water. The water supply may include a hot water inlet 43 and a cold water inlet 45, a valve assembly which may include a hot water valve 47, a cold water valve 49, and a conduit 50. The valves 47, 49 are selectively openable to provide water, such as from a household water supply to the conduit 50. The valves 47, 49 may be opened individually or together to provide a mix of hot and cold water at a selected temperature. While the valves 47, 49 and conduit 50 are illustrated exteriorly of the cabinet 12, it may be understood that these components may be internal to the cabinet 12. A supply conduit 44 may fluidly couple the water supply 42 to the tub 20 and the detergent dispenser 40. The supply conduit 44 may be provided with an inlet valve 46 for controlling the flow of liquid from the water supply 42 through the supply conduit 44 to either the tub 20 or the detergent dispenser 40.

A liquid conduit 48 may fluidly couple the detergent dispenser 40 with the tub 20. The liquid conduit 48 may couple with the tub 20 at any suitable location on the tub 20 and is shown as being coupled to a front wall of the tub 20 in FIG. 1 for exemplary purposes. The liquid that flows from the detergent dispenser 40 through the liquid conduit 48 to the tub 20 typically enters a space between the tub 20 and the drum 14 and may flow by gravity to a sump 52 formed in part by a lower portion of the tub 20. The sump 52 may also be formed by a sump conduit 54 that may fluidly couple the lower portion of the tub 20 to a pump 56. The pump 56 may direct fluid to a drain conduit 58, which may drain the liquid outside the washing machine 10, or to a recirculation conduit 60, which may terminate at a recirculation inlet 62. The recirculation inlet 62 may direct the liquid from the recirculation conduit 60 into the drum 14 or tub 20. The recirculation inlet 62 may introduce the liquid into the drum 14 or tub 20 in any suitable manner, such as by spraying, dripping, or providing a steady flow of the liquid.

The liquid supply and recirculation system may further include one or more devices for heating the liquid such as a steam generator 64 and/or a sump heater 66. The steam generator 64 may be provided to supply steam to the treating chamber 16, either directly into the drum 14 or indirectly through the tub 20 as illustrated. The inlet valve 46 may also be used to control the supply of water to the steam generator 64. The steam generator 64 is illustrated as a flow through steam generator, but may be other types, including a tank type steam generator. Alternatively, the heating element 66 may be used to heat laundry (not shown), air, the rotatable drum 14, or liquid in the tub 20 to generate steam, in place of or in addition to the steam generator 64. The steam generator 64 may be used to heat the laundry as part of a cycle of operation, much in the same manner as heating element 66, as well as to introduce steam to treat the laundry.

Additionally, the liquid supply and recirculation system may differ from the configuration shown in FIG. 1, such as by inclusion of other valves, conduits, detergent dispensers, sensors, to control the flow of liquid through the washing machine 10 and for the introduction of more than one type of detergent/wash aid. Further, the liquid supply and recirculation system need not include the recirculation portion of the system or may include other types of recirculation systems.

Figure 2:
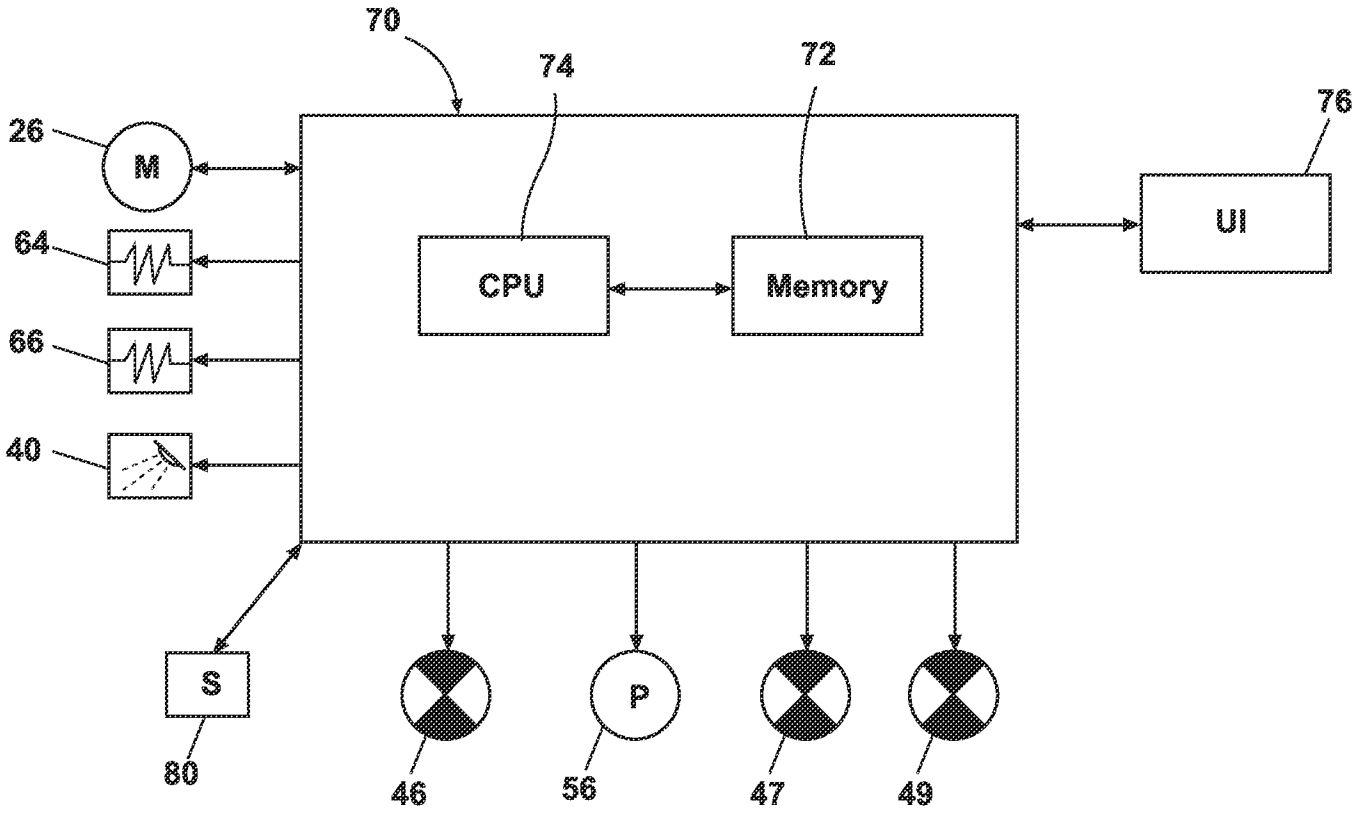
FIG. 2 is a schematic representation of a controller for controlling the operation of one or more components of the laundry treating appliance of FIG. 1.

The laundry treating appliance 10 may further include a controller 70 coupled with various working components of the laundry treating appliance 10 to control the operation of the working components. As illustrated in FIG. 2, the controller 70 may be provided with a memory 72 and a central processing unit (CPU) 74. The memory 72 may be used for storing the control software that may be executed by the CPU 74 in completing a cycle of operation using the laundry treating appliance 10 and any additional software. The memory 72 may also be used to store information, such as a database or table, and to store data received from the one or more components of the laundry treating appliance 10 that may be communicably coupled with the controller 70.

The controller 70 may be operably coupled with one or more components of the laundry treating appliance 10 for communicating with and/or controlling the operation of the components to complete a cycle of operation. For example, the controller 70 may be coupled with the hot water valve 47, the cold water valve 49, and the detergent dispenser 40 for controlling the temperature and flow rate of treating liquid into the treating chamber 16; the pump 56 for controlling the amount of treating liquid in the treating chamber 16 or sump 52; the motor 26 for controlling the direction and speed of rotation of the drum 30; and the user interface 76 for receiving user selected inputs and communicating information to the user.

The controller 70 may also receive input from one or more sensors 80, which are known in the art and not shown for simplicity. Non-limiting examples of additional sensors 80 that may be communicably coupled with the controller 70 include: a temperature sensor including a negative temperature coefficient (NTC) sensor or a positive temperature coefficient (PTC) sensor, a liquid level sensor which may be operably coupled to the tub 20 to detect the liquid level in the tub 20 and transmit the signal to the controller 70 such that the amount of liquid may be selectively controlled in the tub 20 during a cycle of operation, a weight sensor, a motor torque sensor, and a transducer such as a potentiometer.

The laundry treating appliance 10 may perform one or more manual or automatic treating cycle or cycles of operation. A common cycle of operation includes a wash phase, a rinse phase, and a spin extraction phase. Other phases for cycles of operation include, but are not limited to, intermediate extraction phases between the wash and rinse phases, and a pre-wash phase preceding the wash phase, and some cycles of operation include only a selected one or more of these exemplary phases.

A cycle of operation may be performed in the presence of liquid to effect the laundry in the interior of the treating chamber 16. During the cycle of operation, the laundry may absorb at least a portion of the liquid provided into the treating chamber 16. Generally, the absorbency of the laundry load tends to depend on the absorbency of fabric materials or the size of the laundry load. For example, all other things being equal, the laundry having less absorbent fabric such as polyester may absorb small amount of liquid, while the laundry having highly absorbent fabric such as 100% cotton may absorb large amount of liquid. Similarly, all other things being equal, a larger load of the same type of fabric will absorb more liquid than a small load of the same type of fabric. Thus, it is possible for a large load of relatively non-absorbent fabric to absorb about the same amount of liquid as a medium or small load of relatively absorbent fabric.

The amount of liquid absorbed by the load impacts the amount of liquid needed for a given cycle of operation. In the horizontal axis washing machine illustrated in FIG. 1, for example, the liquid provided is normally of a sufficient amount such that the drum 14 may rotate without exceeding a predetermined acceptable torque level and avoiding unnecessarily high contact/loading between the interior of the drum 14 and the laundry. The preferred liquid amount may be selected such that the laundry has a degree of buoyancy in the liquid in the interior of the treating chamber 16 to ensure the motor torque levels are within the design range of the motor 40 and the relative loading between the drum 14 and the laundry is acceptable. Too little liquid leads to unacceptable torque levels and high loading interaction with the laundry, and too much liquid is wasteful. The amount of liquid necessary is dependent on the absorbency of the laundry as the absorbed liquid, in an overly-simplified description, tends not to contribute to the buoyancy.

There are a variety of liquid fill methodologies for supplying the right amount of liquid for a given load, alone, or in combination with the selected cycle of operation. Some of the simplest systems just set the liquid level based on load size, without concern for the corresponding selected cycle of operation or the load type. The load size may be input by the user or automatically determined by the controller 70 as part of the cycle of operation. When automatically determined, the determination is typically based on an inertia method, which relates to the mass/weight of the load. In the user input approach, the user may arbitrarily select from a group of qualitative load sizes, such as "Extra-Small", "Small", "Medium", "Large", and "Extra-Large", using buttons on the user interface 76, to select the load size. While the qualitative load sizes typically have some correspondence to a corresponding mass/weight, users are not always proficient is accurately determining the qualitative load size in terms of mass/weight, resulting in user-inputted load sizes being more inconsistent and subject to greater error than automatically determined load sizes. This is especially true when the laundry type or load type is particularly dense or less dense, which can lead to a small volume, but heavy load, or a large volume, but light load. Thus, it can be important to determine the load type for purposes of determining the proper load size.

Known methods to detect the load type require the addition of water to the laundry load to determine, for example, the absorption characteristics of the laundry load. However, determining the load type after a laundry cycle has progressed to the stage where water has been dispensed may result in a non-optimal laundry cycle. For example, it is also important to know the load type to ensure that the proper temperature of the water is dispensed into the treating chamber 16 is not too hot or too cold for the fabrics of the garments that constitute the load type. To determine a load type before the addition of water to the laundry load, the interaction of the laundry's fabric surface characteristics and the rotating or oscillating laundry mover may be measured and analyzed. A sensor that outputs a signal responsive to the interaction may be in electrical communication with the controller 70. While the following description describes the signal as a measurement of the motor torque profile, other sensors and methods are contemplated. Other sensors may include a current sensor for measuring motor current, a load cell for measuring force and an accelerometer for measuring acceleration.

The problems associated with determining the type and/or size of laundry load may be addressed by evaluation of motor torque signals using both frequency and time domain analysis prior to dispensing water into the treating chamber 16. Every system or structure has one or more natural frequencies. A natural frequency is the frequency at which a structure oscillates when subjected to a continuous or repeated external force. One way to determine the natural frequency of a structure is to monitor the response of the structure to a perturbation force such as delivered by an impact. When a perturbation force is applied to the structure, the structure will resonate where the resonation may be characterized by ringing and dampening. Consequently, in vibration analysis, structures are typically modeled as a combination of a mass, a spring and a damper. Additionally, for structures where the damping is negligible, structures may be more simply modeled as a combination of a mass and a spring and the undamped natural frequency of the structure may be modeled as:

$$\omega_n = \sqrt{\frac{k}{m}}$$

where k=the spring constant of the structure m=the mass of the structure

Modeling laundry in a treating chamber 16 with the mass and spring model described above, the spring constant k of a laundry load may differentiate load types. That is, different load types may resonate differently in response to a perturbation force. In particular, observation of the frequency response of a laundry load to a perturbation force may provide data necessary to estimate a spring constant of the laundry in the treating chamber. The frequency response of the laundry load is a measure of the frequency domain of the response of the laundry to the perturbation force where the frequency domain refers to the analysis of the response with respect to frequency rather than time. The frequency domain of the response is well-known to be related to the time domain response by a mathematical operator known as a Fourier transform. However, frequency domain analysis is computationally more complex, especially for real-time analysis, resulting in it often being shunned in the laundry treating art. With the advent of faster processors, with greater memory, and Fast Fourier Transforms (FFT), it is now more practical to use frequency domain analysis in laundry treating appliances.

Figure 3:
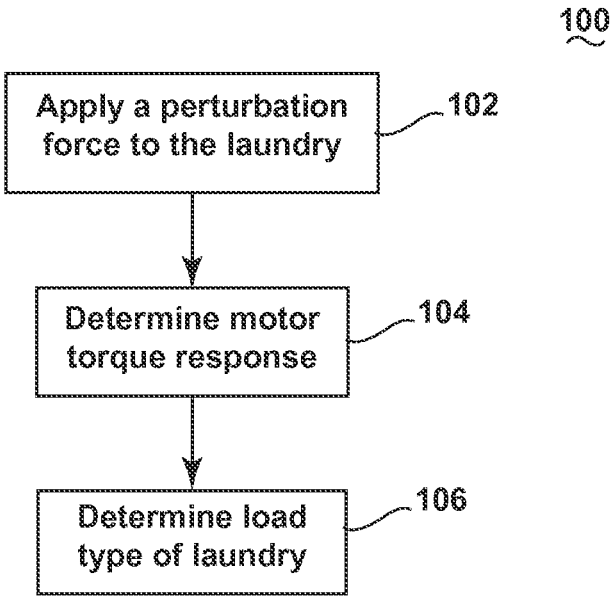
FIG. 3 is a flowchart showing a method of determining the load type of laundry based on the motor torque response to a perturbation force according to an embodiment of the invention.

Referring now to FIG. 3 showing a method 100 to determine the response of a load type, the controller 70 may apply a perturbation force to the laundry 102 in the treating chamber 16 by effecting the rotation of the laundry mover with the motor 26. Then, based on observation and analysis of the motor torque and speed profiles, the controller 70 may determine the motor torque response 104. The resulting observations may provide a unique signature that may determine the load type of laundry 106.

Figure 4:
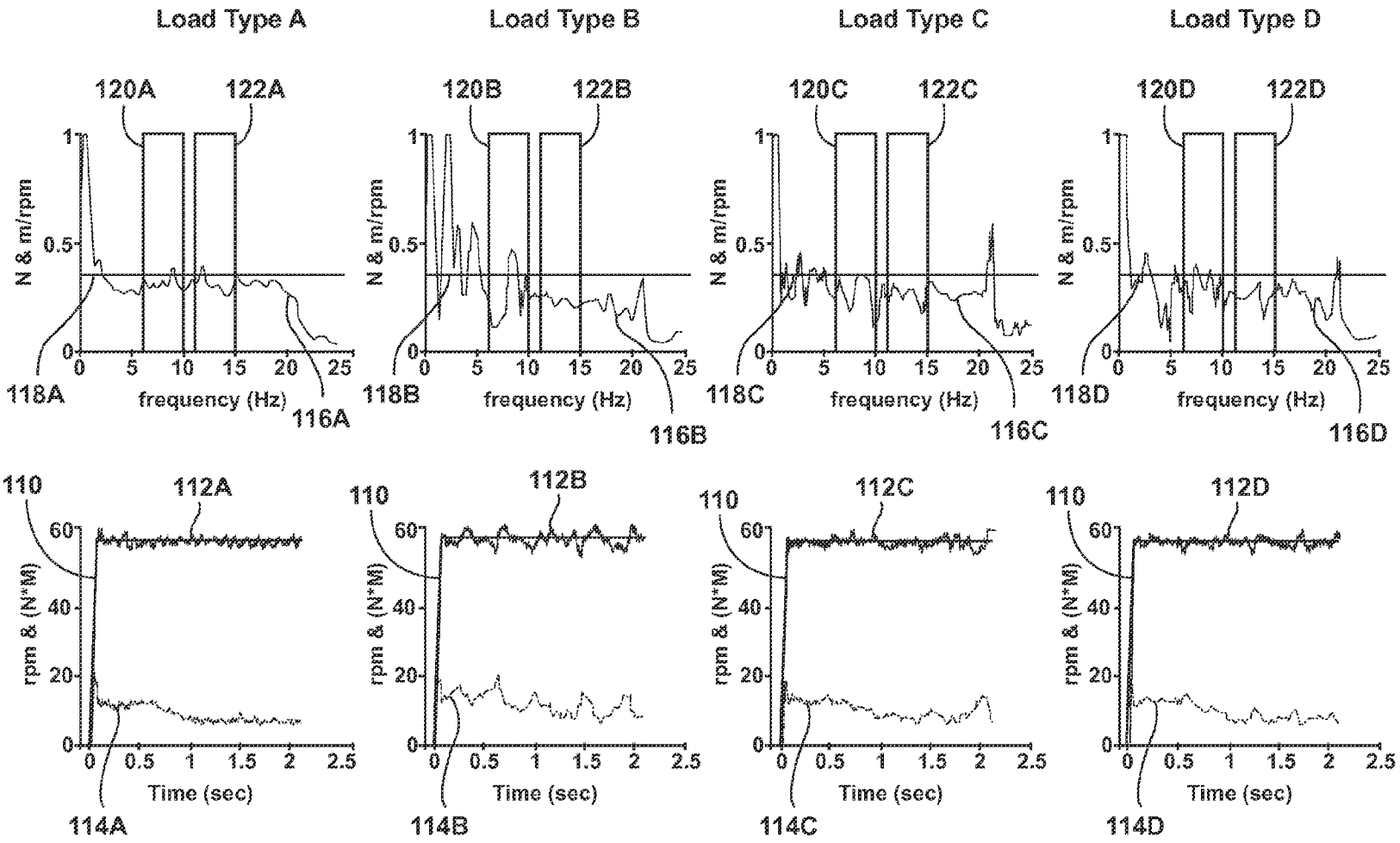
FIG. 4 is a schematic plot illustrating the torque and speed responses of a motor of the laundry treating appliance of FIG. 1 for different load types.

For example, referring now to FIG. 4, the torque and speed profiles of the motor 26 for four different load types of laundry in response to a perturbation force are shown. The controller 70 may initiate a desired speed profile 110 including an initial acceleration phase followed by a steady state phase to accelerate the laundry mover to a predetermined angular velocity. For example, the controller 70 may command the motor 26 to accelerate the laundry mover at approximately 1000 revolutions per minute per second (rpm/s) from a stationary position to spin at approximately 60 revolutions per minute (rpm) after 0.06 s. Then, the controller 70 may command a steady state rotation of the laundry mover for approximately 2.5 s.

The controller 70 may initiate any desired speed profile depending upon the implementation. Other accelerations and speeds are contemplated and may be initiated by the controller 70. The controller 70 may initiate any speed profile with an initial angular acceleration of the laundry mover of sufficient intensity to apply an impulsive perturbation force to the laundry in the laundry mover followed by steady state rotation of the laundry mover. The steady state rotation may be adjusted to more or less than 60 rpm and maintained for any amount necessary for the observation of the laundry response.

While the drum 14 in the treating chamber 16 rotates, the laundry load is lifted by the impeller vanes 24 in the treating chamber 16 and then falls back to the bottom of the drum 14. The impact of the laundry load as it falls in the laundry mover during the acceleration phase of the desired speed profile 110 may provide the perturbation force necessary to induce a resonance in the laundry load. Because of the movement of the laundry load in the laundry mover, the actual speed profile 112 may fluctuate about the desired speed profile 110 as the controller 70 adjusts the motor torque to maintain the desired speed profile 110.

Consequently, the motor torque profile 114, plotted in FIG. 4 in Newton meters (N·m), may reflect the fluctuations corresponding to the response of the laundry load to the perturbation force. A frequency domain representation 116 of the motor torque profile 114, plotted FIG. 4 in Newton meters per revolutions per minute (N·m/rpm) versus cycles per second (Hz), may exhibit a unique spectral response for each laundry load type.

By analysis of the spectral response, the controller 70 may use the motor torque profile 114 to detect different load types. The controller 70 may apply a predetermined threshold to the frequency domain representation 116 of the motor torque profile 114. Though the threshold may be constant or variable per frequency, one preferred threshold 118 is a constant value applied to a normalized frequency domain representation 116 of the motor torque profile 114. In particular, the resultant frequency domain representation 116 may be normalized by dividing, per frequency, the frequency domain representation 116 of the observed motor torque profile 114 by a function indicative of the motor torque operating characteristic. In other words, the motor 26 is capable of outputting a torque signal with a specific response in the frequency domain where the torque per frequency is not constant. For example, the torque delivered by the motor 26 may be reduced at higher frequencies. By normalizing the frequency domain representation 116 of the motor torque profile 114 by the motor torque operating characteristic, the controller 70 may apply a constant value threshold to the frequency domain representation 116 of the motor torque profile 114 where frequencies with intensities above the threshold are then used for load type detection.

To represent the spectral signature of the load type, the controller 70 may then group bands of frequencies into predetermined bins 120, 122 and assign a value to the bin. For example, the controller 70 may assign a certain value to the bin if the normalized frequency domain representation 116 of the motor torque profile 114 exceeds the predetermined threshold 118 for any frequency in the bin. In this way, the controller 70 may sparsely represent the spectral response of the laundry load by using the predetermined threshold 118 and then determine the load types based upon the representation.

For example, load type A has a specific frequency response with a peak above the predetermined threshold 118 in both a 6-10 Hz bin 120A and the 11-15 Hz bin 122A. Load types B, C and D do not have a specific frequency response with a peak above the predetermined threshold 118 in the 11-15 Hz bin 122B, C, D. In this example, load type A may be distinguished by the observation of a specific frequency response with peaks above the predetermined threshold 118 in both the 6-10 Hz bin 120A and the 11-15 Hz bin 122A.

Depending upon the specific types of laundry loads to be detected, any number of bins and frequency allocations for the bins may be implemented. While the example in FIG. 4 demonstrates two frequency bins 120, 122 for distinguishing four laundry load types with a single threshold 118, additional bins with variable threshold values are contemplated. In general, the number and bandwidth of the frequency bins should be chosen to optimally discriminate between the types of laundry loads that require different characteristics for a cycle of operation including water level and temperature.

Alternatively, knowledge of the manually selected cycle of operation may be used, in part, to determine the number and bandwidth of the frequency bins. Distinguishing between some types of laundry loads may be unnecessary if, for example, the washing cycle that will be applied will be the same for two different laundry load types.

In determining the load type by the method described above, it may be desirable to oscillate the laundry mover to better characterize the spectral response of the laundry load. Oscillating the laundry mover enables collection of an ensemble of responses to multiple independent reversing step functions. In other words, determining a load type of laundry may be enhanced by performing a repeated series of steps to apply perturbation force to the laundry and determine the motor torque response. The controller 70 may accelerate the laundry mover to a steady state velocity in one direction followed by accelerating the laundry mover to a steady state velocity in the opposite direction. Subsequent analysis may increase the probability of successfully detecting the laundry load type.

When using the motor torque profile 114 or the frequency domain representation 116 of the motor torque profile 114 to detect the laundry load response, a number of additional variables may be considered because the motor torque profile 114 may not be completely determined by the laundry load response to the perturbation force. For example, as previously described, when modeling a laundry load as a mass-spring system, the undamped natural frequency of the laundry load is not only proportional to the spring constant, but also inversely proportional to the size of the laundry load's mass. Consequently, the controller 70 must directly measure or estimate the size of the laundry load's mass when determining the laundry load response. Without a measurement or estimate of the size of the laundry load's mass, the controller 70 may not be able to distinguish between a light laundry load of a first type and a heavy laundry load of a second type.

While many methods are known to estimate the size of the laundry load, one preferred method of estimating the size of the laundry load is by determination of a moment of inertia of the laundry mover with the laundry load. To determine the moment of inertia, the controller 70 may drive the laundry mover to predetermined rotational velocities and observe the acceleration and/or deceleration times. The controller 70 may convert the observed acceleration and/or deceleration times to moments of inertia and then estimate the size of the laundry load's mass based on the calculated values of the moments of inertia.

Figure 5:
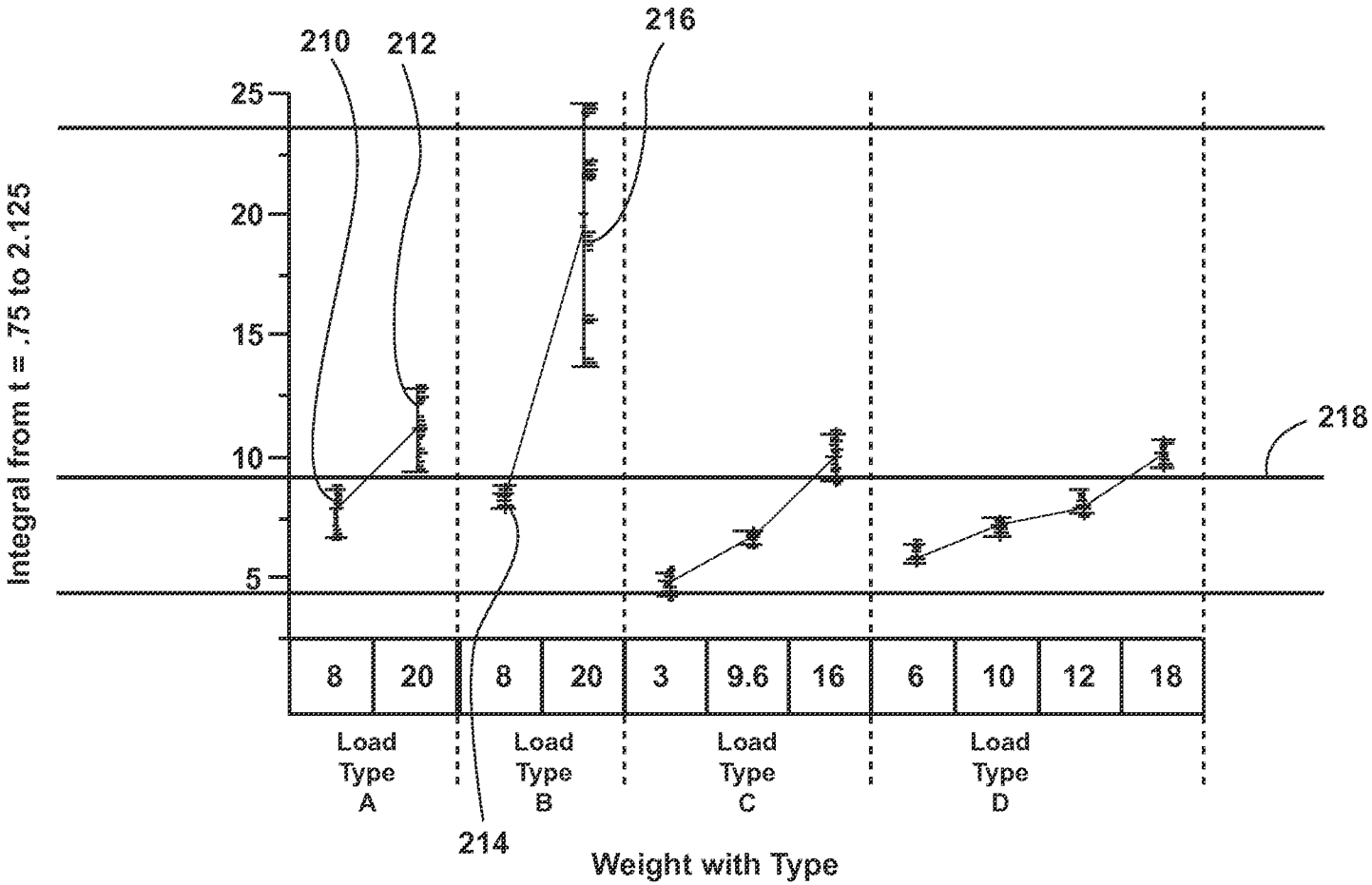
FIG. 5 is a variability chart illustrating the determination of laundry load weight based on the motor torque response for different load types.

Alternatively, to estimate the size of the laundry load, the controller 70 may integrate the motor torque profile 114 during the steady state rotational velocity phase of the speed profile to determine a value correlated to the size of the laundry load's mass. Referring now to FIG. 5, a variability chart for the integration of the motor torque profiles shown in FIG. 4 versus different sized laundry loads demonstrates that motor torque integration may be used to discriminate a light load from a heavy load. While the value of the motor torque profile integrated in the steady state rotational velocity phase (taken to be the duration of time shown in FIG. 4 from 0.75 to 2.125 s) may vary across the different load types, an overall threshold may discriminate between a heavy load and a light load.

For example, the integrated motor torque for load type A is shown to have an expected value ranging from 7 to 8 for an 8 pound (lb) load 210 and an expected value ranging from 9 to 13 for a 20 lb load 212. In contrast, the integrated motor torque for load type B is shown to have an expected value ranging from 8 to 9 for an 8 pound (lb) load 214 and an expected value ranging from 13 to 25 for a 20 lb load 216. While each laundry load type may be expected to induce different ranges of integrated motor torque values, an overall threshold 218 may be set and used to provide coarse resolution estimate of the load size. For example, for the four laundry types shown in FIG. 5, an overall threshold 218 set to be 9 may be used to discriminate a light load from a heavy load.

Other factors that may affect the motor torque profile include the geometry and material properties of the treating chamber. For instance, the shape and configuration of the impeller vanes 24 may impose a transfer function relating the response of the laundry load to the frequency domain representation of the motor torque profile. If, for example, a particular impeller vane 24 configuration imposes a transfer function that attenuates a frequency that fundamentally characterizes a laundry load type, then that load type may become very difficult to detect. However, the controller 70 may use prior knowledge of the impact of a particular impeller vane configuration to account for the induced filtering effect. Alternatively, the impeller vane configuration may be selected to enhance the detectability of certain load types.

The invention described herein determines the type and size of the laundry load. The invention may be advantageous in that the type and size of the laundry load may be determined within a short period of time, prior to wetting of the laundry. As a result of detecting the fabric type of laundry load prior to wetting of the laundry, hot or cold water can be applied independently of the detection process as needed for optimal consumer desired performance. Consequently, the washing machine may implement a wash cycle to obtain optimal cleaning performance and/or energy. For instance, if the washing machine detects a laundry load primarily comprising of blue jeans, the tumbling or impeller oscillation of the wash cycle may be configured to optimize cleaning performance. In contrast, if the machine detects a load that requires a delicate cycle then the wash cycle can be gentler and the drum can spin at lower speeds.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of determining a laundry load fabric type in a clothes washing machine having a treating chamber containing an un-wetted laundry load, a rotatable laundry mover, and a motor operably coupled to the rotatable laundry mover, the method comprising:

prior to wetting of the laundry load, applying a perturbation force to the un-wetted laundry load in the treating chamber by rotating the laundry mover with the motor;

determining, by a controller, a response to the perturbation force during the rotating of the laundry mover; and determining, by the controller, the laundry load fabric type based on the determined response; and selectively providing a liquid to the treating chamber based on the determined laundry load fabric type.

2. The method of claim 1 wherein the applying the perturbation force comprises applying an impact force.

3. The method of claim 2 wherein the rotating the laundry mover comprises rotating the laundry mover at a steady state after the application of the perturbation force.

4. The method of claim 3 wherein the determining the response occurs during the steady state.

5. The method of claim wherein the rotating the laundry mover comprises rotating the motor at a predetermined speed profile.

6. The method of claim 5 wherein the determining the response to the perturbation force comprises determining a motor torque response to maintain the predetermined speed profile.

7. The method of claim 5 wherein the speed profile comprises an initial acceleration phase.

8. The method of claim 7 wherein the perturbation force is applied during the initial acceleration phase.

9. The method of claim 8 wherein the speed profile comprises a steady state phase after the initial acceleration phase, and the determining the response to the perturbation force comprises determining a motor torque response during the steady state phase.

10. The method of claim 1 wherein rotating the laundry mover comprises at least one of rotating a drum at least partially defining the treating chamber or rotating a clothes mover located within the treating chamber.

11. The method of claim 1 wherein determining the response to the perturbation force comprises determining a motor torque response in at least one of the time domain or the frequency domain.

12. The method of claim 11 further comprising determining a load size value, and the determining the laundry load fabric type is based on the motor torque response and the load size value.

13. The method of claim 12 wherein determining the load size value comprises determining an inertia value for the laundry load.

14. The method of claim 12 wherein determining the laundry load fabric type comprises comparing the motor torque response in the frequency domain to at least one reference value for the load size value.

15. The method of claim 12 further comprising wetting the laundry load by selectively providing a liquid to the treating chamber based on the determined laundry load fabric type, and wherein the applying the perturbation force occurs prior to the wetting of the laundry load.

16. The method of claim 1 wherein determining the laundry load fabric type based on the determined response includes estimating a spring constant of the laundry load.

17. The method of claim 1 wherein rotating the laundry mover comprises oscillating the laundry mover.

18. The method of claim 1 wherein the determined response is one of motor torque, motor current, load cell force or accelerometer acceleration.

19. The method of claim 1 wherein the determined response results from an interaction between fabric surface characteristics of the laundry load and the laundry mover.

20. A method of determining a laundry load fabric type in a laundry treating appliance having a treating chamber containing a laundry load, a rotatable laundry mover, and a motor operably coupled to the rotatable laundry mover, the method comprising:

applying a perturbation force to the laundry load in the treating chamber by rotating the laundry mover with the motor;

determining, by a controller, a resonance response by the laundry load to the perturbation force during the rotating of the laundry mover; and determining, by the controller, a laundry load fabric type based on the determined resonance response.

* * * * *